US008043175B2

(12) United States Patent
Chen

(10) Patent No.: US 8,043,175 B2
(45) Date of Patent: Oct. 25, 2011

(54) SENSING HOME PLATE

(76) Inventor: Sung-Jen Chen, Jhonghe (TW)

( * ) Notice: Subject to any disclaimer, the term of this patent is extended or adjusted under 35 U.S.C. 154(b) by 0 days.

(21) Appl. No.: 12/709,031

(22) Filed: Feb. 19, 2010

(65) Prior Publication Data

US 2011/0183786 A1 Jul. 28, 2011

(30) Foreign Application Priority Data

Jan. 27, 2010 (TW) ..... 99201615 U

(51) Int. Cl.
*A63B 71/00* (2006.01)
*A63B 69/00* (2006.01)

(52) U.S. Cl. ..... 473/500; 473/456

(58) Field of Classification Search ..... 473/453, 473/422, 454–456, 421, 468, 499, 500; 463/2, 463/3; 434/247
See application file for complete search history.

(56) References Cited

U.S. PATENT DOCUMENTS

| | | | | | |
|---|---|---|---|---|---|
| 1,868,088 | A * | 7/1932 | Blair | 473/499 |
| 2,943,141 | A * | 6/1960 | Knight | 348/157 |
| 4,545,576 | A * | 10/1985 | Harris | 473/468 |
| 4,563,005 | A * | 1/1986 | Hand et al. | 473/455 |
| 4,577,863 | A * | 3/1986 | Ito et al. | 473/453 |
| 4,583,733 | A * | 4/1986 | Ito et al. | 473/453 |
| 4,652,121 | A * | 3/1987 | Ito et al. | 356/28 |
| 4,834,375 | A * | 5/1989 | Elstein et al. | 473/417 |
| 5,069,450 | A * | 12/1991 | Pyle | 473/415 |
| 5,199,705 | A * | 4/1993 | Jenkins et al. | 473/415 |
| 5,401,016 | A * | 3/1995 | Heglund et al. | 473/476 |
| 5,553,846 | A * | 9/1996 | Frye et al. | 473/455 |
| 5,566,934 | A * | 10/1996 | Black et al. | 473/431 |
| 5,676,607 | A * | 10/1997 | Stumpf | 473/455 |
| 5,741,182 | A * | 4/1998 | Lipps et al. | 463/36 |
| 5,820,496 | A * | 10/1998 | Bergeron | 473/455 |
| 5,833,549 | A * | 11/1998 | Zur et al. | 473/199 |
| 6,042,492 | A * | 3/2000 | Baum | 473/453 |
| 6,159,113 | A * | 12/2000 | Barber | 473/454 |
| 6,350,211 | B1 * | 2/2002 | Kolmar | 473/454 |
| 6,358,164 | B1 * | 3/2002 | Bracewell et al. | 473/454 |
| 6,616,556 | B1 * | 9/2003 | Osmudsen | 473/452 |
| 6,688,996 | B1 * | 2/2004 | Mitani | 473/500 |
| 6,985,206 | B2 * | 1/2006 | Anderson et al. | 352/28 |
| 7,150,688 | B1 * | 12/2006 | Coulbourn | 473/415 |
| 7,270,616 | B1 * | 9/2007 | Snyder | 473/453 |
| 7,335,116 | B2 * | 2/2008 | Petrov | 702/149 |
| 2003/0171169 | A1 * | 9/2003 | Cavallaro et al. | 473/455 |
| 2006/0183546 | A1 * | 8/2006 | Addington et al. | 463/37 |

* cited by examiner

*Primary Examiner* — Mitra Aryanpour
(74) *Attorney, Agent, or Firm* — Muncy, Geissler, Olds & Lowe, PLLC

(57) ABSTRACT

A sensing home plate, structurally assembled from a home plate main body, and a sensing device disposed therein. The sensing device is assembled from a power supply circuit, a signal transmitting circuit, a fine tuning circuit, a signal receiving circuit, and an acousto-optic circuit. The signal transmitting circuit transmits signals, and forms a sensing area on the upper side of the home plate main body. When a baseball passes through or contacts the sensing area causing interference therewith, then a signal is received by the signal receiving circuit, and the acousto-optic circuit emits sound and light as a means to indicate such. The present invention can thus be used in the sport of baseball to accurately determine whether or not the ball pitched by the pitcher is a strike (good pitch) or ball (bad pitch), thereby assisting the chief umpire in making decisions, and reducing judgmental errors.

5 Claims, 3 Drawing Sheets

SENSING HOME PLATE

BACKGROUND OF THE INVENTION (a) Field of the Invention

The present invention relates to a sensing home plate, and more particularly to a sensing home plate assembled from a home plate main body, and a sensing device disposed in the interior of the main body, and which is applicable for use in the sport of baseball to accurately determine strikes (good pitches) and balls (bad pitches) to assist the chief umpire in making decisions, and thereby reduce erroneous judgments.

(b) Description of the Prior Art

The sport of baseball is a very well-known sport, however, just like any other sport, baseball is subject to erroneous judgments made by the umpire.

In the present sport of baseball, because the decision of whether a pitch is a strike (good pitch) or a ball (bad pitch) is still determined by the chief umpire. And although baseball rules already stipulate the zone of a strike (good pitch) thrown by the pitcher, however, because of individual factors of the chief umpire, the aforementioned erroneous judgments frequently occur.

The aforementioned arguments over strikes (good pitches) or balls (bad pitches) will inevitably occur in situations where there is no chief umpire on site to determine strikes (good pitches) and balls (bad pitches), or in situation where a non-professional individual temporarily fills the position of the chief umpire, such as a baseball practice field. Furthermore, in official baseball games, the influence power of whether decisions made by the chief umpire are correct or not far exceeds that of other sports. For example, in basketball and soccer, after the referee blows a whistle, if any of the aforementioned arguments occur, then game time is temporarily suspended, and film captured by cameras can be replayed to visually inspect the true, correct result. However, game time in official baseball games cannot be interrupted, thus, the instantaneous decision of a strike (good pitch) or ball (bad pitch) is enough to affect the following action of the baseball player and the result of the baseball game.

Hence, fairness of baseball decisions is easily subject to question, resulting in disputes, and is one of the primary reasons why baseball cannot be included as an official event in the Olympic Games.

In order to reduce erroneous judgments, and increase the correctness of decisions made, apart from training to strengthen the skills of umpires, if scientific methods could also be used to accurately determine strikes (good pitches) and balls (bad pitches), as well as instantaneously display the results to show impartiality, then such methods would certainly contribute to the fairness of baseball games and reduce disputes. However, since the development of the sport of baseball up to the present time, no related designs have been seen that are able to determine strikes (good pitches) or balls (bad pitches) to assist the chief umpire in making decisions.

SUMMARY OF THE INVENTION

In light of the above, the present invention provides a sensing home plate able to accurately determine strikes (good pitches) and balls (bad pitches) to assist the chief umpire in making decisions, thereby reducing erroneous judgments.

Accordingly, a primary objective of the present invention is to provide a sensing home plate structurally designed and assembled from a home plate main body, and a sensing device disposed in the interior of the main body, thereby enabling the sensing home plate to be used in the sport of baseball. Hence, when a ball pitched by the pitcher passes through or contacts a strike zone sensing area already set up, then an acousto-optic circuit is used to emit sound and light as a means to indicate such, thereby unequivocally differentiating between a strike (good pitch) and a ball (bad pitch), achieving assisting the chief umpire in making a decision, and reducing erroneous judgments. Moreover, the present invention provides improvement and advancement.

In order to realize the aforementioned objectives, the present invention adopts the following technological means.

A preferred embodiment of the present invention is structurally assembled from the sensing home plate, primarily comprising the home plate main body, and the sensing device disposed in the interior of the main body.

The aforementioned home plate main body is manufactured in the standard shape of the home plate as used in the sport of baseball, and is provided with appropriate thickness.

The aforementioned sensing device is assembled to primarily comprise a power supply circuit, a signal transmitting circuit, a fine tuning circuit, a signal receiving circuit, and an acousto-optic circuit.

The power supply circuit provides the power required for the aforementioned sensing device system to operate.

The signal transmitting circuit is used to transmit signals, forming a sensing area on the upper side of the home plate main body.

The fine tuning circuit is used to adjust the range, upper height and lower height of the sensing area to form a strike zone.

The signal receiving circuit is used to receive interference signals from the sensing area, whereby when a baseball passes through or contacts the sensing area causing interference therewith, then a signal is received by the signal receiving circuit and transmitted to the acousto-optic circuit.

The acousto-optic circuit comprises a sound producing unit, which is used to emit sound; and a light-emitting unit, which is used to emit light. As soon as the receiving circuit receives an interference signal caused by the baseball passing through or contacting the sensing area, then the acousto-optic circuit emits sound and light as a means to indicate such.

Accordingly, the aforementioned sound producing and light emitting indicative means of the present invention can be used in the sport of baseball to accurately determine whether or not the ball pitched by the pitcher is a strike (good pitch) or ball (bad pitch), thereby assisting the chief umpire in making decisions, and reducing judgmental errors.

To enable a further understanding of said objectives and the technological methods of the invention herein, a brief description of the drawings is provided below followed by a detailed description of the preferred embodiments.

DETAILED DESCRIPTION OF THE PREFERRED EMBODIMENTS

Figure 1:
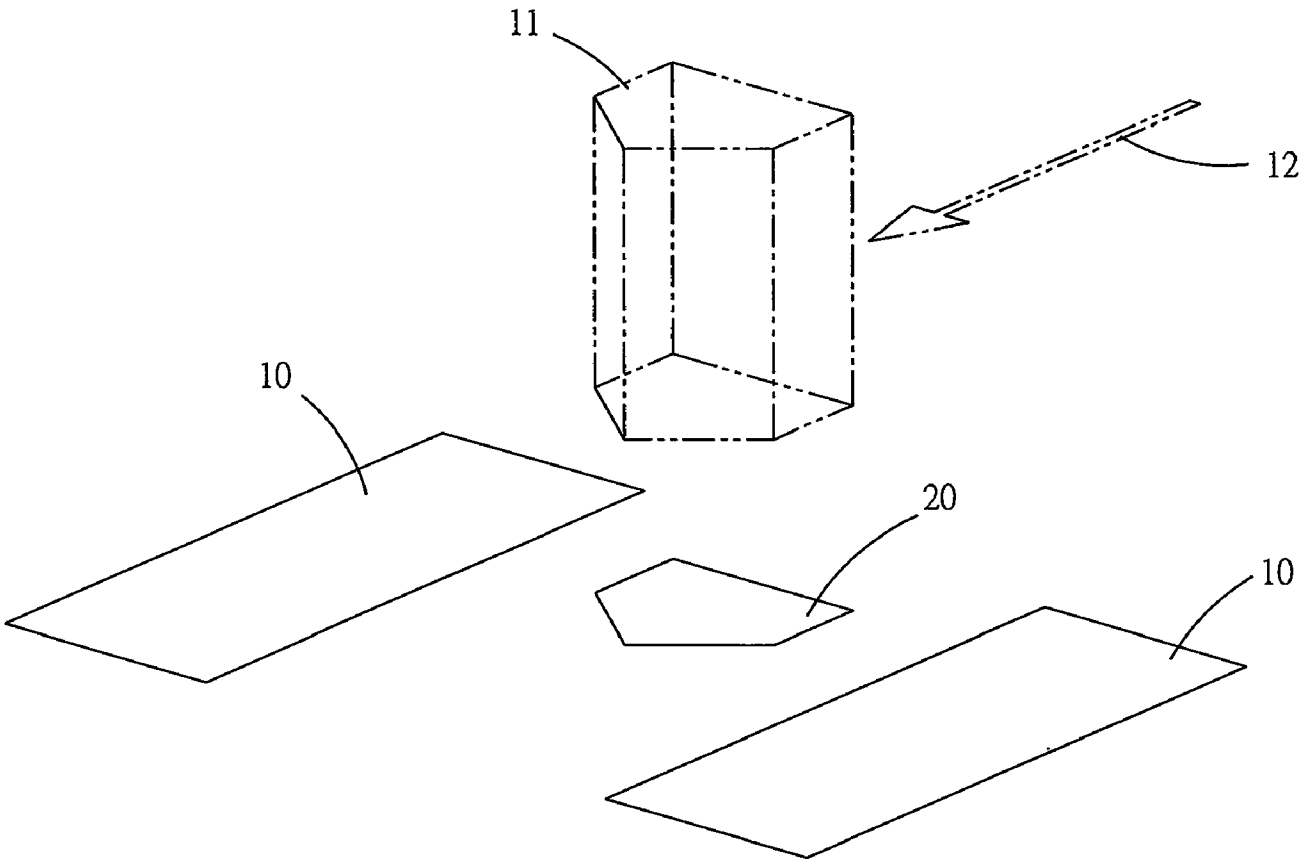
FIG. 1 is a schematic view depicting an exemplary use of a sensing home plate according to the present invention.

The attached FIG. 1 is a schematic view depicting an exemplary use of a sensing home plate 20 of the present invention.

Figure 2:
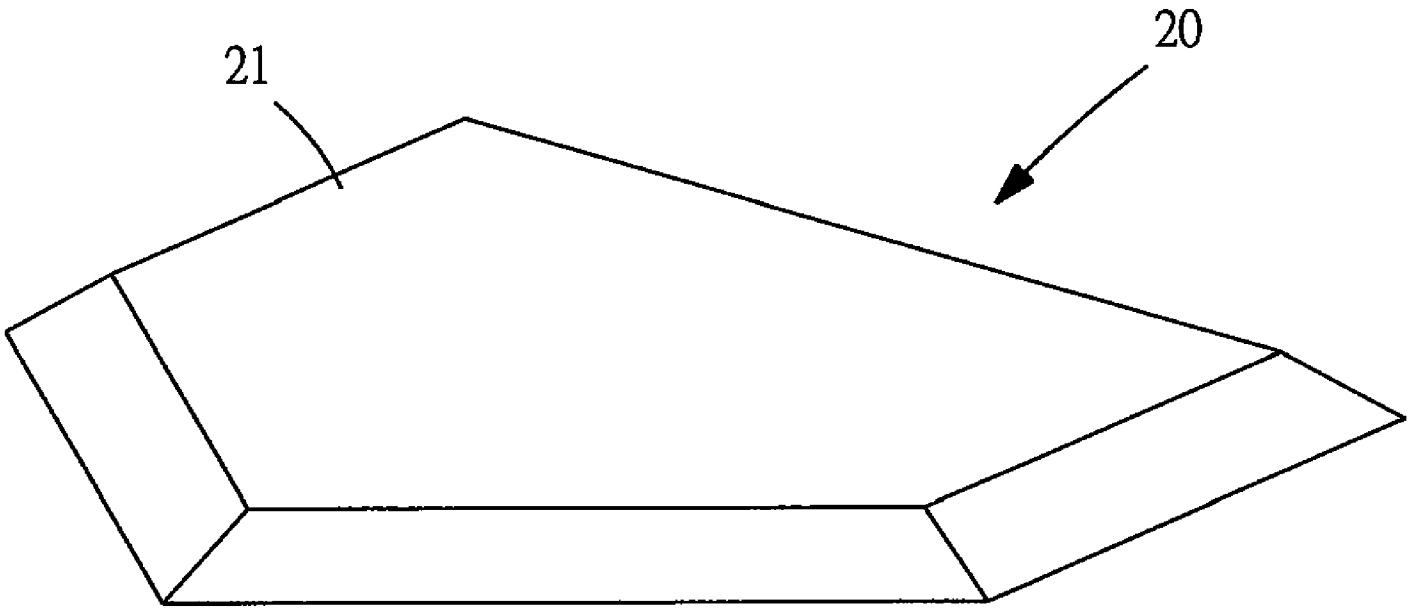
FIG. 2 is an elevational view depicting an external appearance of an embodiment of the sensing home plate according to the present invention.

FIG. 2 is an elevational view depicting an external appearance of an embodiment of the sensing home plate 20 according to the present invention.

And preferred embodiments of the present invention, as depicted in FIG. 1 and FIG. 2, show that the sensing home plate 20 is primarily structured to comprise a home plate main body 21, and a sensing device disposed in the interior of the main body.

The aforementioned home plate main body 21 is manufactured in the standard shape of the home plate as used in the sport of baseball, and is provided with appropriate thickness.

Figure 3:
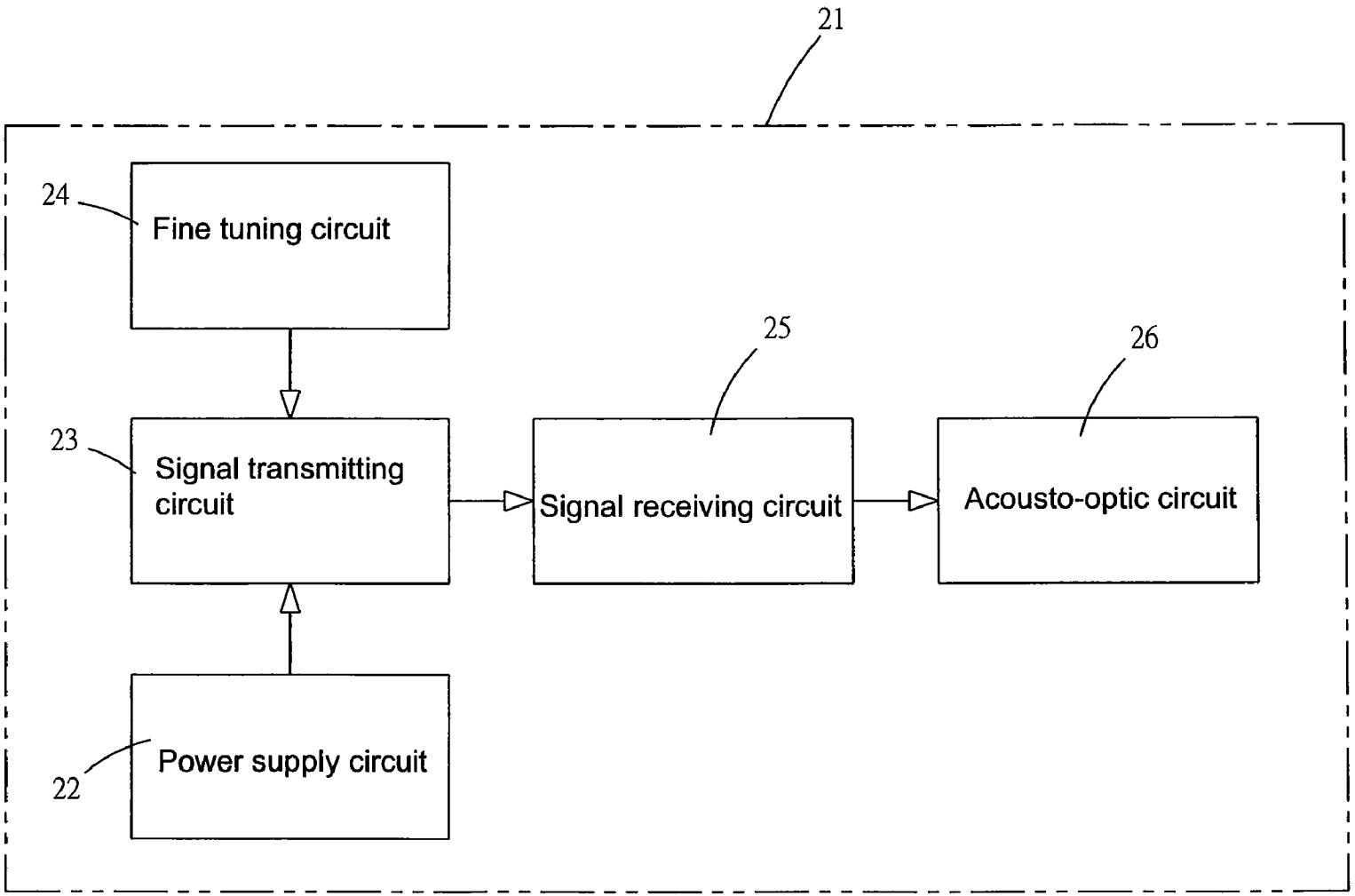
FIG. 3 is a structural block diagram of the sensing home plate according to the present invention.

FIG. 3 is a structural block diagram of the sensing home plate according to the present invention.

And as depicted in FIG. 3, the aforementioned sensing device installed in the interior of the home plate main body 21 is primarily structured to comprise a power supply circuit 22, a signal transmitting circuit 23, a fine tuning circuit 24, a signal receiving circuit 25, and an acousto-optic circuit 26.

The power supply circuit 22 provides the power required for the aforementioned sensing device system to operate.

The power supply circuit 22 can use replaceable batteries concealed in the interior of the home plate main body 21, or conducting wires can also be used that enable electrical connection with an exterior alternating current supply.

The aforementioned signal transmitting circuit 23 is used to transmit signals, forming a sensing area 11 on an upper side of the home plate main body 21, as depicted in FIG. 1.

The aforementioned fine tuning circuit 24 is used to adjust the range, upper height and lower height of the aforementioned sensing area 11 to define a strike zone.

Such a function enables adjusting the position and range size of the sensing area 11 to enable the sensing area 11 to view batters of different stature.

Wired or wireless control means can be used to achieve the aforesaid adjustment function.

The aforementioned signal receiving circuit 25 is used to receive interference signals from the sensing area 11, as depicted in FIG. 1, whereby when a baseball passes through or contacts the sensing area 11 from an incoming ball direction 12 causing interference therewith, then a signal is received by the signal receiving circuit 25 and transmitted to the acousto-optic circuit 26.

The aforementioned acousto-optic circuit 26 comprises a sound producing unit, such as a buzzer, which is used to emit sound; and a light-emitting unit, such as LED light-emitting bodies, which are used to emit light. As soon as the signal receiving circuit 25 receives an interference signal caused by the baseball passing through or contacting the sensing area 11, then the acousto-optic circuit 26 emits sound and light as a means to indicate such.

Accordingly, the aforementioned sound producing and light emitting indicative means of the present invention can be used in the sport of baseball to accurately determine whether or not the ball pitched by the pitcher is a strike (good pitch) or ball (bad pitch), thereby assisting the chief umpire in making the correct decision, and reducing judgmental errors.

Taking the aforementioned sound producing means as an example, for instance, after the pitcher pitches the ball, and the ball does not pass through or contact the sensing area 11, then the buzzer remains silent and does not emit sound, at which time the chief umpire can easily make the decision that the pitch did not pass through the strike zone, and is thus a ball (bad pitch). On the contrary, if the baseball passes through or contacts the sensing area 11, then such a passing is indicated by the buzzer emitting rapid short 'beeping' sounds, thereby enabling the chief umpire to easily decide that the pitched ball passed through the strike zone and is a strike (good pitch), thus avoiding making any erroneous judgments, and achieving the intended objective.

Taking the aforementioned light emitting means as an example, for instance, after the pitcher pitches the ball, and the ball does not pass through or contact the sensing area 11, then the plurality of LED light-emitting bodies disposed on the surface of the home plate main body 21 appear constantly lit with a blue light, at which time the chief umpire can easily make the decision that the pitch did not pass through the strike zone, and is thus a ball (bad pitch). On the contrary, if the baseball passes through or contacts the sensing area 11, then the constantly lit blue lights change into flashing red lights, thereby enabling the chief umpire to easily decide that the pitched ball is a strike (good pitch), thus avoiding making any erroneous judgments, and achieving the same intended objective.

The aforementioned sound producing means can be singly used, or the light emitting means can be singly used in the sensing home plate 20 of the present invention to indicate strikes (good pitches) or balls (bad pitches). Moreover, both the sound producing means and the light emitting means can be simultaneously used as the indicative display, thereby reducing the possibility of making any erroneous judgments.

In conclusion, the aforementioned embodiments of the present invention can clearly achieve the intended functions and objectives. Moreover, the present invention has been described in detail to enable persons familiar with the art to implement accordingly. However, it is to be understood that the embodiments described herein are merely illustrative of the principles of the invention and that a wide variety of modifications thereto may be effected without departing from the spirit and scope of the invention as set forth in the following claims.

What is claimed is:

1. A sensing home plate, comprising:

a home plate main body, having a standard shape of home plate used in baseball, and an appropriate thickness;

a sensing device, installed in an interior of the home plate main body, the sensing device forming a sensing area defining a strike zone with adjustable range size on an upper side of the home plate main body from wireless signals, so that if a baseball passes through or contacts the sensing area causing interference therewith, then the sensing device uses sound and light emitting devices which indicate the baseball is in the strike zone;

the sensing home plate accurately determining whether the baseball is a strike (good pitch) or ball (bad pitch), thereby assisting a chief umpire in making decisions, and reducing judgmental errors;

wherein the sensing device comprises:

a power supply circuit, the power supply circuit provides the power required for the sensing device system to operate;

a signal transmitting circuit, used to transmit signals, forming the sensing area on the upper side of the home plate main body;

a fine tuning circuit, used to adjust the width, upper height and lower height of the sensing area to form a strike zone;

a signal receiving circuit, used to receive interference signals from the sensing area, whereby when a baseball passes through or contacts the sensing area from an incoming ball direction causing interference therewith, then a signal is received by the signal receiving circuit and transmitted to an acousto-optic circuit; and the acousto-optic circuit, comprising a sound producing unit, and a light-emitting unit, whereby as soon as the receiving circuit receives an interference signal caused by the baseball passing through or contacting the sensing area, then the acousto-optic circuit emits sound and light to indicate whether the baseball is in the strike zone.

2. The sensing home plate according to claim 1, wherein the power supply circuit uses replaceable batteries concealed in the interior of the home plate main body, or conducting wires are used that enable electrical connection with an exterior alternating current supply.

3. The sensing home plate according to claim 1, wherein the fine tuning circuit uses a wired device to achieve adjustment function, or uses a wireless control device to achieve adjustment function.

4. The sensing home plate according to claim 1, wherein the sound producing device is singly used, or the light emitting device is singly used to indicate strikes (good pitches) or balls (bad pitches).

5. The sensing home plate according to claim 1, wherein both the sound producing device and the light emitting device are simultaneously used to indicate strikes (good pitches) or balls (bad pitches).

* * * * *